US006443070B1

(12) United States Patent
Mauberger

(10) Patent No.: US 6,443,070 B1
(45) Date of Patent: Sep. 3, 2002

(54) FLOOR FOR CIRCULATING BETWEEN TWO VEHICLES

(75) Inventor: Thierry Pierre Mauberger, Joue les Tours (FR)

(73) Assignee: Faiveley Transport, St. Denis (FR)

( * ) Notice: Subject to any disclaimer, the term of this patent is extended or adjusted under 35 U.S.C. 154(b) by 0 days.

(21) Appl. No.: 09/721,246

(22) Filed: Nov. 22, 2000

(30) Foreign Application Priority Data

Nov. 26, 1999 (FR) ..... 99 14923

(51) Int. Cl.[7] ..... B61D 17/20

(52) U.S. Cl. ..... 105/8.1; 105/3; 105/458; 250/403

(58) Field of Search ..... 105/3, 4.1, 8.1, 105/10, 425, 432, 458; 280/403

(56) References Cited

U.S. PATENT DOCUMENTS 1,040,529 A * 10/1912 Douglas ..... 105/3
2,051,958 A * 8/1936 Madison ..... 105/3
3,754,515 A * 8/1973 Van Der Sluys et al. ..... 105/8
4,405,143 A * 9/1983 Rosenkrands ..... 280/403

FOREIGN PATENT DOCUMENTS

| | | |
|---|---|---|
| DE | 9307065 | 8/1993 |
| EP | 0672001 | 9/1995 |
| EP | 0722873 B1 * | 11/1995 |
| GB | 2093781 A * | 8/1992 |
| WO | 9506580 | 3/1995 |

* cited by examiner

*Primary Examiner*—S. Joseph Morano
*Assistant Examiner*—Frantz F. Jules
(74) *Attorney, Agent, or Firm*—Gray Cary Ware & Freidenrich LLP

(57) ABSTRACT

The invention concerns a floor making it possible to circulate between two vehicles connected together by an articulated connection. The floor according to the invention includes a first deck fixed to the end of one of the vehicles and a second deck fixed to the end of the other vehicle. These two fixed decks are each partially covered by a movable deck, and are connected to each other by two deformable members including links and connecting rods. The movable deck is thus guided kinematically by the deformable parallelogram during the movements of the vehicles, notably when going round bends.

12 Claims, 1 Drawing Sheet

FLOOR FOR CIRCULATING BETWEEN TWO VEHICLES

The invention concerns a floor making it possible to circulate between two vehicles connected together by an articulated link.

This floor is intended in particular for an inter-carriage access corridor for passengers between two cars of a railway vehicle, such as for example coaches of a tramcar, underground railway or train, or a road vehicle, such as for example a bus.

Such inter-carriage access floors are already known.

In particular, the document EB-B-0 722 873 describes an inter-carriage access gangway comprising several members sliding on each other and a scissors chassis making it possible to avoid the formation of gaps between the members on bends.

In the device described by the document EP-B-0 722 873, the chassis is under spring tension, which has the effect that the different members return to their original position after they have deviated in a bend.

Such a device has the drawback of comprising numerous parts under friction, sensitive to wear. Moreover, because of the large number of parts, assembling this type of gangway is relatively complicated.

The object of the present invention is to produce a circulation floor between vehicles comprising a reduced number of moving parts in order to limit the wear through friction, whilst being suitable for adapting to the relative movements between the vehicles.

This floor also has the advantage of being able to be amounted easily on different types of vehicle.

To this end, the floor according to the invention comprises a first deck fixed to the end of one of the vehicles and a second deck fixed to the end of the other vehicle. These two fixed decks are each covered partially by a movable deck, and they are connected to each other by two deformable members.

Each deformable member comprises two links articulated on each other and respectively connected in an articulated fashion to each of the said fixed decks. each link is connected to the other link by two connecting rods which are articulated together and fixed in an articulated Fashion to each of the links at a point lying between a fixed articulation point and the common articulation point or the two links.

The two connecting rods thus form, with the two links, a deformable parallelogram, the common articulation point of the two connecting rods being fixed to the movable deck and able to move in rotation with respect to this movable deck.

The movable deck is thus guided kinematically by the deformable parallelogram during the movements of the vehicles Other particularities and advantages of the invention will also emerge from the following. description.

In the accompanying drawings given by way of non-limitative examples:

BRIEF DESCRIPTION OF THE DRAWINGS

FIG. 1 depicts a floor 1 making it possible to pass between two vehicles, not shown, connected together by an articulated connection, not shown.

The floor comprises:

a first deck 2 fixed to the end of one of the vehicles;

a second deck 3 fixed to the end of the other vehicle;

a movable deck 4 resting on the fixed decks 2 and 3.

Figure 2:
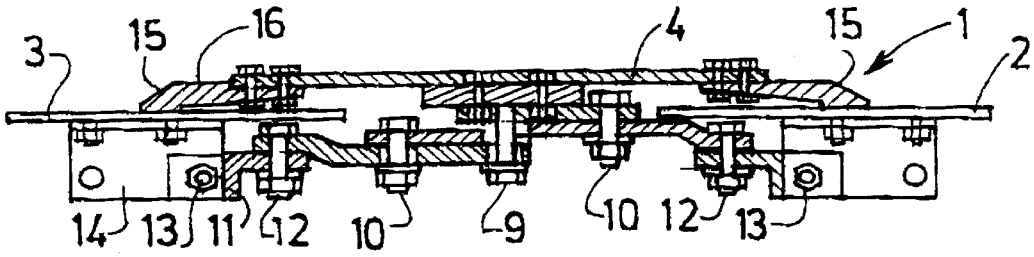
FIG. 2 depicts a view in section of the floor according to the invention.
Figure 3:
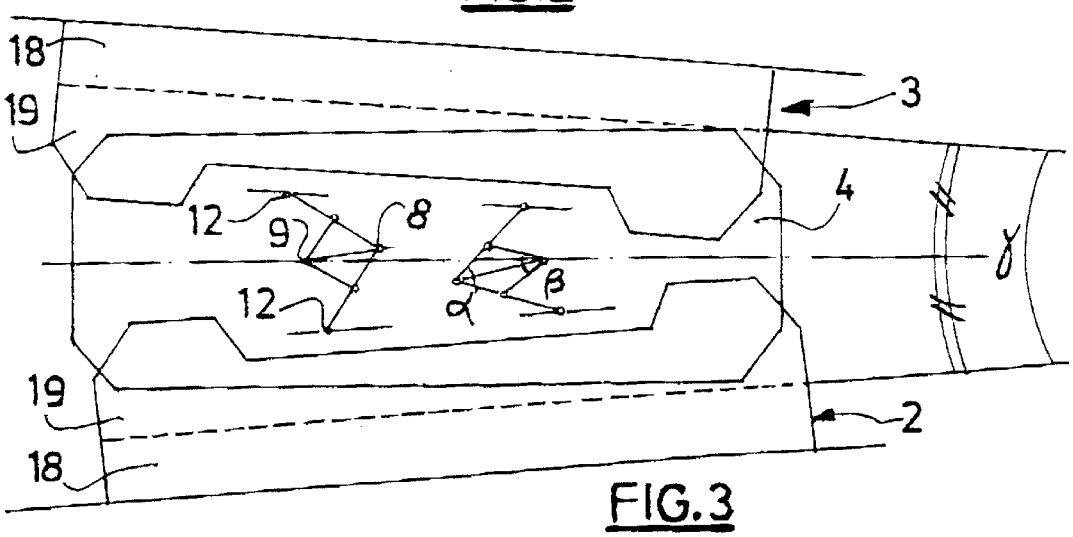
FIG. 3 depicts an outline diagram of the floor seen from above when the vehicles are going round a bend.

The two fixed decks 2, 3 are thus each covered partially by the movable deck 4, as depicted in FIGS. 2 and 3.

The fixed and movable decks are made from a strong rigid material, able to withstand slight deformations, such as or example metal or a composite.

The two fixed decks 2, 3 are connected to each other by two deformable members 5 of the same type.

Each deformable member 5 comprises two links 6 and two connecting rods 7.

The two links 6 are articulated on each other by their ends by ,means of an articulation 8 whose axis is perpendicular to the plane of the movable deck 4.

The ends of the links 6 opposite to the articulation 8 are connected in an articulated fashion to each of the said fixed decks 2, 3.

Each link 6 is connected to the other link 6 by two connecting rods 7.

The connecting rods 7 are connected by ad articulation 9, and are fixed by articulations 10 to each of the links 6.

The articulations 10 are thus situates on the links 6 at a point lying between a fixed articulation point and the common articulation 8 of the two links 6.

In this embodiment depicted in the figures, the articulations 10 are placed at the middle of the links 6.

The two connecting rods 7 thus form, with the two links 6, a deformable parallelogram 5.

The articulation 9, common to the two connecting rods 1 is fixed to the movable deck 4, whilst being able to move in rotation about an axis perpendicular to this movable deck.

This common articulation 9 is situated on the longitudinal axis of symmetry of the movable deck 4.

The ends of the link 6 opposite to their common articulation 8 are each fixed in an articulated fashion to an arm 11, itself connected in an articulated fashion to a fixed deck 2, 3.

Each articulation 12 connecting a link 6 to an arm 11 has an axis perpendicular to the plane of the movable deck 4.

The shaft of the articulation 13 connecting an arm 11 to a fixed deck 2, 3 is parallel to the plane of the floor and to the longitudinal direction of the fixed deck 2, 3.

In the embodiment depicted in FIG. 2, the articulation shaft 13 is fixed to a fork joint 14 fixed by screws to the bottom face of the fixed decks 2, 3.

The association of the two articulations 13 thus makes it possible to compensate for the variations in height caused by the relative movement of the two vehicles.

The axes of the links 6 and connecting rods 7, as depicted in FIG. 2, are substantially parallel to the plane of the movable deck 4, the axes of the articulations 8, 9, 10 and 12 being perpendicular to this plane.

The articulation axes of each parallelogram are therefore perpendicular so the plane formed by the decks 2, 3, 4 when there is no difference in level between the decks 2, 3.

Figure 1:
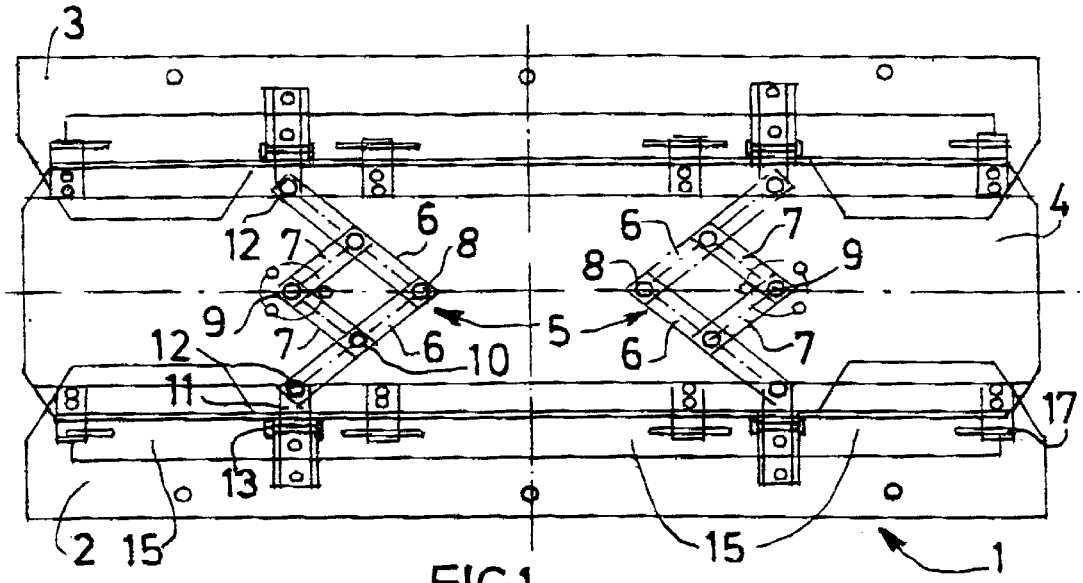
FIG. 1 is a plan view of the floor according to the invention.

In the embodiment depicted in FIG. 1, the fixed decks 2, 3 and movable deck 4 being parallel to each other, the two deformable parallelograms 5 are symmetrical with each other with respect to the median axis of the movable deck, perpendicular to the longitudinal axis of the latter, the common articulation point 8 of the links 6 of each parallelogram being close to the said median axis.

The lengths of the links 6 and connecting rods 7 are such that, for each parallelogram 5, the articulation 9 fixed to the movable deck and the two articulations 12 connected to the fixed decks by the arms 11 are always aligned whatever the relative positions of the fixed decks.

This characteristic enables the movable deck 4 to return into alignment with the fixed decks 2, 3 when the vehicles are following a rectilinear direction.

The movable deck 4 rests on the fixed decks 2, 3 through at least two sliding runners 15 distributed regularly over each of its longitudinal edges.

In the embodiment depicted in the figures, each longitudinal edge of the movable deck 4 comprises three regularly distributed runners 15.

Each runner 15 is fixed to the edge of the movable deck 4 by means of a hinge 16 fixed by screws to the edge of the movable deck. The axis 17 of the hinge is parallel to the longitudinal edge of the movable deck.

The runners 15 are produced from a wear-resistant material.

The deformable parallelograms 5 are adjusted so that the space between the movable deck and the fixed decks is sufficiently small to prevent the passage of objects or fingers of a passenger between the decks.

A slight prestressing applied to the movable deck also makes it possible to compensate for rocking.

The movable deck 4 thus does not rest directly on the fixed decks. The runners 15, connected to the movable deck 4, serve as exchangeable wear parts.

The surface of the fixed decks 2, 3 on which the runners 15 are able to move during movements of the vehicles is smooth, in order to limit the friction and wear on the runners.

The other surfaces of the fixed decks 2, 3 and movable deck 4 are rough in order to avoid the passengers slipping.

The dimensions and shape of the movable deck 4 are such that the latter overlaps each of the fixed decks 2, 3 according to a surface area sufficient to maintain this overlap whatever the relative positions of the two vehicles.

The movable deck 4 has sufficient flexibility to be able to deform and remain in contact with the fixed decks 2, 3 in the event of rocking movement and/or difference in level between the two vehicles.

The small rocking angles between the bodies are taken up in the deformable parallelogram by virtue of the clearances and elastic deformations in the links and connecting rods.

The fixed decks 2 and 3 are fixed to the vehicles by screws. They can for example be fixed to the bodies of the vehicles.

In the embodiment depicted in FIG. 3, each of the fixed decks 2, 3 comprises a rough surface part 18 and a smooth surface part 19.

The dimensions of the smooth part 19, resulting from kinematic movement calculations, are sufficient for the runners 15 nor to rest on the rough part 18 whatever the relative positions of the fixed decks 2, 3 and movable deck 4.

The deformable parallelogram is then fixed to the part 19, the latter being fixed by screws to the part 18. The part 19 subject to wear can thus easily be changed.

The part 18 is then fixed to the body of the vehicle.

This embodiment makes it possible by adapting the floor to different types of vehicle by adapting the dimensions of the part 18 of the fixed decks.

The floor can thus easily he removed or refitted, on different vehicles.

The functioning of the floor according to the invention is now described in, detail with reference to FIG. 3.

An angle $\alpha$ formed by the links 16 between each other and an angle $\beta$ formed by the connecting rods 7 between each other are defined for each parallelogram 5.

The longitudinal edges of the necks 2, 3 (or parts 18), opposite to the longitudinal edges fixed to the vehicle, form between them an angle $\gamma$.

When going round a curve, such as a bend to the right depicted in FIG. 3, the articulation points 12 of the parallelogram 5 close to the centre of curvature move closer to each other. This moving closer together causes a reduction in the angles $\alpha$ and $\beta$.

Conversely, the articulation points 12 of the parallelogram 5 distant from the centre of curvature move away from each other. This moving away causes an increase in the angles $\alpha$ and $\beta$.

During this movement, the articulation points 9 and 12 of each parallelogram 5 remain aligned, each articulation point 9 remaining equidistant from the articulation points 12, so that, on emerging from the bend, the fixed decks 2, 3 and movable deck 4 will be positioned by themselves with respect to each other so that the longitudinal axis of the deck 4 aligns with the bisecting line of the angle $\gamma$, without requiring the intervention of a return means, such as a spring.

The articulation axis 13 being parallel to the plane of the floor, the end of the arm 11 connected to an articulation 12 can move in a direction perpendicular to the plane of the floor. This particular articulation makes it possible to take up any differences in level which may form between the different decks.

Any rocking movements are for their pare borne by the movable deck 4 by virtue of a certain bending flexibility of the latter.

Rocking can be taken up at the deformable parallelograms, for example by a flexible mounting at the articulations 12 or 13.

I claim:

1. A floor for circulating between a first and second vehicle connected together by an articulated connection, comprising a first deck (2) capable of being fixed to the end of the first vehicle and a second deck (3) capable of being fixed to the end of the second vehicle, said two decks (2,3) each being covered partially by a movable deck (4), the two decks being connected to each other by two deformable members (5), each deformable member (5) comprising two links (6) articulated on each other and respectively connected in an articulated manner to each of the said first and second decks, each link (6) being connected to the other link by two connecting rods (7) which are articulated together and fixed in an articulated manner to each of the links (6) at a point lying between a fixed articulation point and a common articulation point (8) of the two links, the two connecting rods (7) forming with the two links (6) a deformable parallelogram, the common articulation point (8) of the two connecting rods (7) being fixed to the movable deck (4)and able to move in rotation with respect to the movable deck (4).

2. A floor according to claim 1, wherein the ends or the links (6) opposite to their common articulation point (8) are each fixed in an articulated manner to an arm (11) which is itself connected in an articulated manner to the fixed deck (2, 3) along an axis parallel to the fixed deck (2, 3) and in the longitudinal direction thereof.

3. A floor according to claim 1, wherein the plane containing the deformable parallelogram is substantially parallel to the plane formed by the first and second decks (2, 3) and movable deck (4), the articulation axes of the said parallelogram being perpendicular to the plane formed by the decks (2, 3, 4), when there is no difference in level between the decks (2, 3).

4. A floor according to claim 1, wherein the common articulation point (9) of the two connecting rods (7) fixed to the movable deck (4) is situated on the longitudinal axis of symmetry of the movable deck (4).

5. A floor according to claim 1, wherein the first and second decks (2,3) and movable deck (4) being parallel to each other, the two deformable parallelograms are symmetrical with each other with respect to the median axis of the movable deck (4), perpendicular to the longitudinal axis, the common articulation point (8) of the links (6) of each parallelogram being close to the median axis.

6. A floor according to claim 1, wherein the lengths of the links (6) and connecting rods (7) are such that the common, articulation (9) of the connecting rods (7), fixed to the movable deck (4), and the articulations (12) of the links (6) connected to the first and second decks (2, 3), are aligned whatever the relative positions of the fixed decks (2, 3) and movable deck (4).

7. A floor according to claim 1, wherein the movable deck (4) covers each of the first and second decks (2, 3) over a sufficient surface to maintain this overlap whatever the relative positions of the two vehicles.

8. A floor according to claim 1, wherein the movable deck (4) has sufficient flexibility so as to be able to deform and to remain in contact with the first and second decks (2, 3) in the event of a rocking movement or difference in level between the two vehicles.

9. A floor according to claim 1, wherein the movable deck (4) rests on the first and second decks (2, 3) through at least two sliding runners (15) regularly distributed on each of the longitudinal edges of the movable deck (4).

10. A floor according to claim 9, wherein the sliding runners (15) are fixed in an articulated manner to the movable deck (4) along an axis parallel to the movable deck and in the longitudinal direction thereof.

11. A floor for circulating between a first and second vehicle connected together by an articulated connection, comprising a first deck capable of being fixed to the end of the first vehicle and a second deck capable of being fixed to the end of the second vehicle, said two decks each being covered partially by a movable deck, the two decks being connected to each other by two deformable members, each deformable member comprising two links articulated on each other and respectively connected in an articulated manner to each of the said first and second decks, each link being connected to the other link by two connecting rods which are articulated together and fixed in an articulated manner to each of the links at a point lying between a fixed articulation point and a common articulation point of the two links, the two connecting rods forming with the two links a deformable parallelogram, the common articulation point of the two connecting rods being fixed to the movable deck and able to move in rotation with respect to the movable deck, the ends of the links opposite to their common articulation point are each fixed in an articulated manner to an arm which is itself connected in an articulated manner to the first and second decks along an axis parallel to the first and second deck and in the longitudinal direction thereof.

12. A floor for circulating between a first and second vehicle connected together by an articulated connection, comprising a first deck capable of being fixed to the end of the first vehicle and a second deck capable of being fixed to the end of the second vehicle, said two decks each being covered partially by a movable deck, the two decks being connected to each other by two deformable members, each deformable member comprising two links articulated on each other and respectively connected in an articulated manner to each of the said first and second decks, each link being connected to the other link by two connecting rods which are articulated together and fixed in an articulated manner to each of the links at a point lying between a fixed articulation point and a common articulation point of the two links, the two connecting rods forming with the two links a deformable parallelogram, the common articulation point of the two connecting rods being fixed to the movable deck and able to move in rotation with respect to the movable deck, the movable deck resting on the first and second decks through at least two sliding runners regularly distributed on each of the longitudinal edges of the movable deck.

* * * * *